US011385577B2

(12) United States Patent
Kodera et al.

(10) Patent No.: US 11,385,577 B2
(45) Date of Patent: Jul. 12, 2022

(54) TRANSPORT DEVICE, FIXING DEVICE, AND IMAGE FORMING APPARATUS

(71) Applicant: FUJIFILM BUSINESS INNOVATION CORP., Tokyo (JP)

(72) Inventors: Tetsuro Kodera, Ebina (JP); Yoshiki Shimodaira, Ebina (JP); Tokuya Sakamoto, Ebina (JP); Kosuke Yamada, Ebina (JP); Masato Yamashita, Ebina (JP); Takayuki Yamashita, Ebina (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/362,358

(22) Filed: Jun. 29, 2021

(65) Prior Publication Data

US 2021/0325805 A1 Oct. 21, 2021

Related U.S. Application Data

(63) Continuation of application No. PCT/JP2019/031499, filed on Aug. 8, 2019.

(30) Foreign Application Priority Data

Mar. 14, 2019 (JP) ..... JP2019-047499

(51) Int. Cl.
*G03G 15/20* (2006.01)

(52) U.S. Cl.
CPC ..... *G03G 15/2028* (2013.01); *G03G 15/20* (2013.01); *G03G 15/2053* (2013.01)

(58) Field of Classification Search
CPC ..... G03G 15/2053; G03G 15/2028
See application file for complete search history.

(56) References Cited

U.S. PATENT DOCUMENTS 3,100,112 A * 8/1963 Davis ..... G03G 15/602 271/3.14
3,137,495 A * 6/1964 Eichorn ..... G03G 15/6511 101/232

(Continued)

FOREIGN PATENT DOCUMENTS

JP 2006-084677 A 3/2006
JP 2006-091043 A 4/2006

(Continued)

OTHER PUBLICATIONS

Oct. 15, 2019 Search Report issued in International Patent Application No. PCT/JP2019/031499.

(Continued)

*Primary Examiner* — Sevan A Aydin
(74) *Attorney, Agent, or Firm* — Oliff PLC

(57) ABSTRACT

A transport device includes: a first nipping part having an outer surface; a second nipping part having an outer surface, the second nipping part being configured to form, with the first nipping part, a nip region in which a recording medium is nipped by bringing the outer surface of the second nipping part into contact with the outer surface of the first nipping part, the second nipping part being relatively movable between a first position at which a distance from the second nipping part to the first nipping part is a first distance at which the nip region is formed and a second position at which the distance from the second nipping part to the first nipping part is longer than the first distance; a transport part including a holder that holds a front end side of the recording medium, the transport part being configured to move the holder to transport the recording medium to pass through the nip region together with the holder while the recording medium is being held by the holder; and a moving mechanism configured to relatively move the second nipping part such that a middle point of a period from when a relative (Continued)

movement of the second nipping part from the first position to the second position is started before a holding position of the recording medium by the holder enters the nip region to when the second nipping part is relatively moved to the first position after the holding position enters the nip region precedes a middle point of a period during which the holding position passes through the nip region.

14 Claims, 14 Drawing Sheets

(56) References Cited

U.S. PATENT DOCUMENTS

| | | | | |
|---|---|---|---|---|
| 3,187,651 | A * | 6/1965 | Eichorn | G03G 15/30 399/377 |
| 3,199,866 | A * | 8/1965 | Eichorn | G03G 15/6529 271/204 |
| 5,255,056 | A * | 10/1993 | Preszler | B41J 13/223 101/415.1 |
| 5,594,536 | A * | 1/1997 | Kawabata | G03G 15/1655 399/297 |
| 2006/0056886 | A1 | 3/2006 | Ohishi et al. | |
| 2010/0189476 | A1* | 7/2010 | Tanaka | G03G 15/657 399/313 |
| 2010/0272480 | A1* | 10/2010 | Kamijo | G03G 15/1675 399/314 |
| 2011/0277317 | A1* | 11/2011 | Mor-Yosef | G03G 15/75 29/700 |
| 2012/0063820 | A1* | 3/2012 | Chiba | G03G 15/0189 399/304 |
| 2013/0230343 | A1* | 9/2013 | Okamoto | G03G 15/1665 399/304 |
| 2017/0031294 | A1 | 2/2017 | Oikawa et al. | |
| 2021/0286304 | A1* | 9/2021 | Shimodaira | G03G 15/5054 |
| 2021/0286305 | A1* | 9/2021 | Sakamoto | G03G 15/602 |
| 2021/0294264 | A1* | 9/2021 | Yamada | G03G 15/657 |
| 2021/0325803 | A1* | 10/2021 | Yamashita | G03G 15/2064 |
| 2022/0032658 | A1* | 2/2022 | Kodera | B41J 2/0057 |
| 2022/0035278 | A1* | 2/2022 | Yamada | B41J 13/22 |
| 2022/0035279 | A1* | 2/2022 | Kodera | B41J 13/22 |
| 2022/0035280 | A1* | 2/2022 | Yamada | B65H 29/044 |
| 2022/0035285 | A1* | 2/2022 | Kodera | G03G 15/104 |

FOREIGN PATENT DOCUMENTS

| | | | |
|---|---|---|---|
| JP | 2006-259223 | A | 9/2006 |
| JP | 2008-164781 | A | 7/2008 |
| JP | 2012-204546 | A | 10/2012 |
| JP | 2013-152282 | A | 8/2013 |
| JP | 2017-026954 | A | 2/2017 |

OTHER PUBLICATIONS

Oct. 15, 2019 Written Opinion of the International Searching Authority issued in International Patent Application No. PCT/JP2019/031499.

* cited by examiner

TRANSPORT DEVICE, FIXING DEVICE, AND IMAGE FORMING APPARATUS

CROSS-REFERENCE TO RELATED APPLICATIONS

This is a continuation of International Application No. PCT/JP2019/31499 filed on Aug. 8, 2019, and claims priority from Japanese Patent Application No. 2019-047499 filed on Mar. 14, 2019.

BACKGROUND

Technical Field

The present disclosure relates to a transport device, a fixing device, and an image forming apparatus.

Related Art

JP-A-2006-259223 discloses a fixing device including: a fixing roll pair including a first fixing roll and a second fixing roll arranged as a pair, at least one of which is a heating roll, and a surface layer of at least one of which is replaceable; a sticking means provided with a sticking member; a charger for charging at least one of a recording medium and the sticking means; and a securing means for physically securing a tip end portion of the recording medium in a transport direction to the sticking means by a gripping part, and in the fixing device, the charger electrostatically attracts the sticking member and the recording medium, the securing means secures the recording medium to the sticking means, and then the fixing roll pair transports the recording medium together with the sticking means while sandwiching the recording medium, thus fixing an image.

SUMMARY

It is considered that a transport device such as the fixing device has a configuration including a first nipping part such as a heating roll; a second nipping part such as a pressure roll that forms, with the first nipping part, a nip region in which the recording medium is nipped and that is relatively movable between a first position at which a distance from the first nipping part is a distance at which the nip region is formed and a second position at which a distance from the first nipping part is longer than the distance at the first position; and a transport part that transports the recording medium by moving a holder that holds a front end side of the recording medium and causes the holder to pass through the nip region.

In this configuration, when a middle point of a period from when a relative movement of the second nipping part from the first position to the second position is started until when the second nipping part is relatively moved to the first position coincides with a middle point of a period during which a holding position where the holder holds the recording medium passes through the nip region, a timing at which the recording medium is nipped by the first nipping part and the second nipping part is delayed.

Aspects of non-limiting embodiments of the present disclosure relate to advancing the timing at which the recording medium is nipped by the first nipping part and the second nipping part, as compared with the configuration in which the middle point of the period from when the relative movement of the second nipping part from the first position to the second position is started until when the second nipping part is relatively moved to the first position coincides with the middle point of the period during which the holding position passes through the nip region.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a transport device including: a first nipping part having an outer surface; a second nipping part having an outer surface, the second nipping part being configured to form, with the first nipping part, a nip region in which a recording medium is nipped by bringing the outer surface of the second nipping part into contact with the outer surface of the first nipping part, the second nipping part being relatively movable between a first position at which a distance from the second nipping part to the first nipping part is a first distance at which the nip region is formed and a second position at which the distance from the second nipping part to the first nipping part is longer than the first distance; a transport part including a holder that holds a front end side of the recording medium, the transport part being configured to move the holder to transport the recording medium to pass through the nip region together with the holder while the recording medium is being held by the holder; and a moving mechanism configured to relatively move the second nipping part such that a middle point of a period from when a relative movement of the second nipping part from the first position to the second position is started before a holding position of the recording medium by the holder enters the nip region to when the second nipping part is relatively moved to the first position after the holding position enters the nip region precedes a middle point of a period during which the holding position passes through the nip region.

BRIEF DESCRIPTION OF DRAWINGS

Exemplary embodiment(s) of the present invention will be described in detail based on the following figures, wherein.

DETAILED DESCRIPTION

Hereinafter, an example of an exemplary embodiment according to the present disclosure will be described with reference to the drawings.

(Image Forming Apparatus 10)

Figure 1:
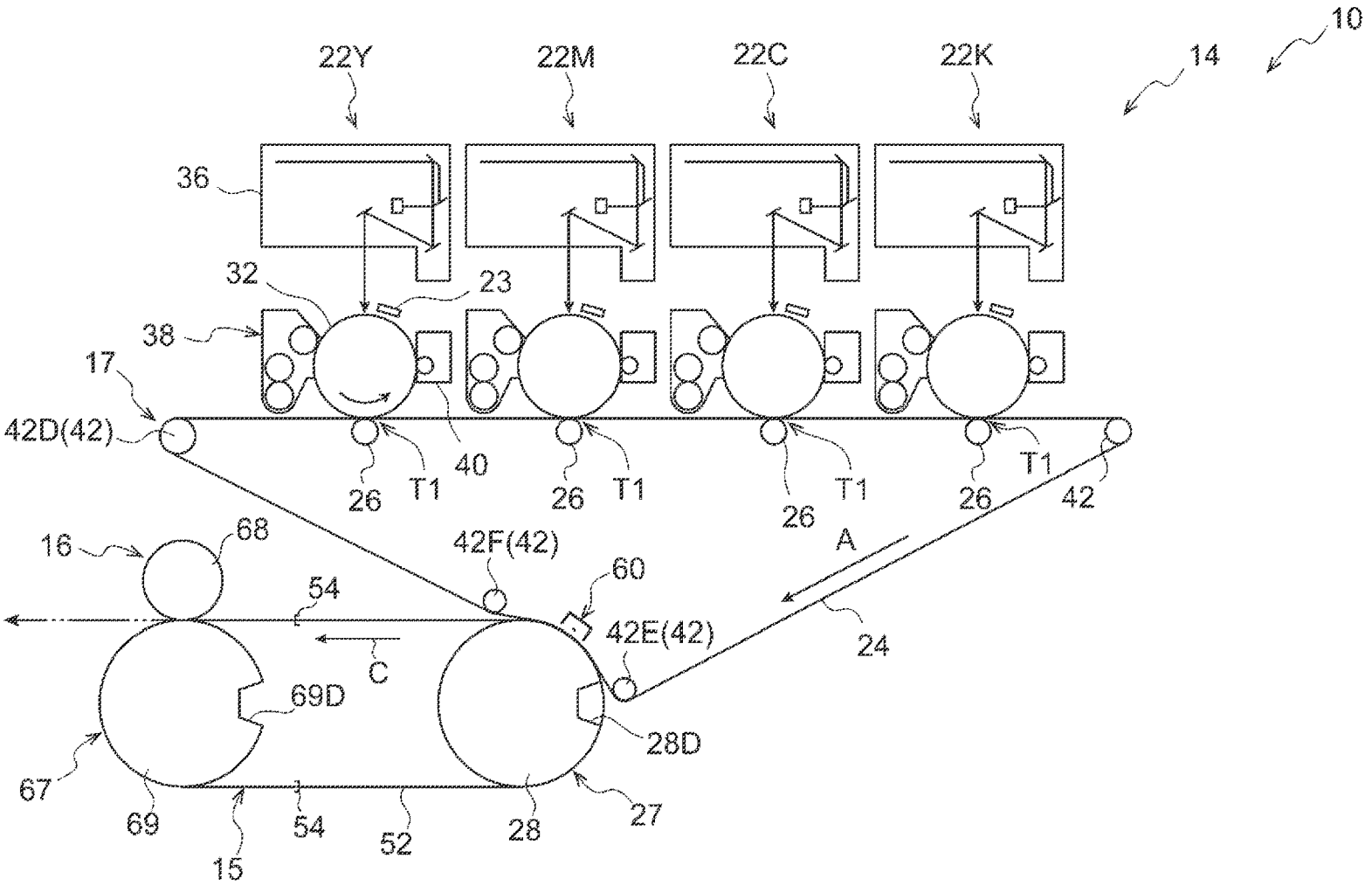
FIG. 1 is a schematic diagram showing an image forming apparatus according to the present exemplary embodiment.

A configuration of an image forming apparatus 10 according to the present exemplary embodiment will be described. FIG. 1 is a schematic diagram showing the configuration of the image forming apparatus 10 according to the present exemplary embodiment.

The image forming apparatus 10 shown in FIG. 1 is an example of an image forming apparatus that forms an image on a recording medium. Specifically, the image forming apparatus 10 is an electrophotographic image forming apparatus that forms a toner image (an example of an image) on a recording medium P. More specifically, the image forming apparatus 10 includes an image forming unit 14 and a fixing device 16. Hereinafter, each part (the image forming unit 14 and the fixing device 16) of the image forming apparatus 10 will be described.

(Image Forming Unit 14)

The image forming unit 14 has a function of forming a toner image on the recording medium P. Specifically, the image forming unit 14 includes a toner image forming unit 22 and a transfer device 17.

(Toner Image Forming Unit 22)

The toner image forming unit 22 shown in FIG. 1 has a function of forming a toner image. Plural toner image forming units 22 are provided so as to form toner images for each color. In the present exemplary embodiment, toner image forming units 22 of a total of four colors of yellow (Y), magenta (M), cyan (C), and black (K) are provided. The (Y), (M), (C), and (K) shown in FIG. 1 show constituent portions corresponding to the respective colors.

Since the toner image forming unit 22 of each color has the same configuration except for the toner to be used, on behalf of the toner image forming unit 22 of each color, each part of the toner image forming unit 22(Y) is designated by a reference numeral in FIG. 1.

Specifically, the toner image forming unit 22 of each color includes a photoconductor drum 32 (photoconductor) that rotates in one direction (for example, in a counterclockwise direction in FIG. 1). Further, the toner image forming unit 22 of each color includes a charging unit 23, an exposure device 36, a developing device 38, and a removing device 40.

In the toner image forming unit 22 of each color, the charging unit 23 charges the photoconductor drum 32. The exposure device 36 exposes the photoconductor drum 32 charged by the charging unit 23 to light, so as to form an electrostatic latent image on the photoconductor drum 32. The developing device 38 develops the electrostatic latent image that is formed on the photoconductor drum 32 by the exposure device 36, to form a toner image. Then, the removing device 40 removes toner remaining on the photoconductor drum 32 after the toner image is transferred to a transfer belt 24 to be described later.

(Transfer Device 17)

The transfer device 17 shown in FIG. 1 is a device that transfers the toner image formed by the toner image forming unit 22 to the recording medium P. Specifically, the transfer device 17 primarily transfers the toner image of the photoconductor drum 32 of each color onto the transfer belt 24 as an intermediate transfer body in a superimposed manner, and secondarily transfers the superimposed toner images onto the recording medium P at a secondary transfer position T2 (a transfer nip region 28A to be described later). More specifically, as shown in FIG. 1, the transfer device 17 includes the transfer belt 24, primary transfer rolls 26, a secondary transfer body 27, and a charging unit 60.

(Primary Transfer Roll 26)

The primary transfer roll 26 shown in FIG. 1 is a roll that transfers the toner image of the photoconductor drum 32 of each color to the transfer belt 24 at a primary transfer position T1 between the photoconductor drum 32 and the primary transfer roll 26. In the present exemplary embodiment, the toner image formed on the photoconductor drum 32 is transferred to the transfer belt 24 at the primary transfer position T1 by applying a primary transfer electric field between the primary transfer roll 26 and the photoconductor drum 32.

(Transfer Belt 24)

The toner image is transferred from the photoconductor drum 32 of each color to an outer circumferential surface of the transfer belt 24 shown in FIG. 1. Specifically, the transfer belt 24 is configured as follows. As shown in FIG. 1, the transfer belt 24 has an annular shape. The transfer belt 24 wraps around plural rolls 42 including a driving roll 42D and wrap rolls 42E, 42F, and a posture of the transfer belt 24 is determined thereby. For example, the driving roll 42D among the plural rolls 42 is rotationally driven by a driving unit (not shown), and thus the transfer belt 24 rotates in a predetermined direction indicated by an arrow A (hereinafter, referred to as a belt rotation direction A). A specific configuration of the wrap rolls 42E, 42F will be described later.

(Secondary Transfer Body 27)

Figure 2:
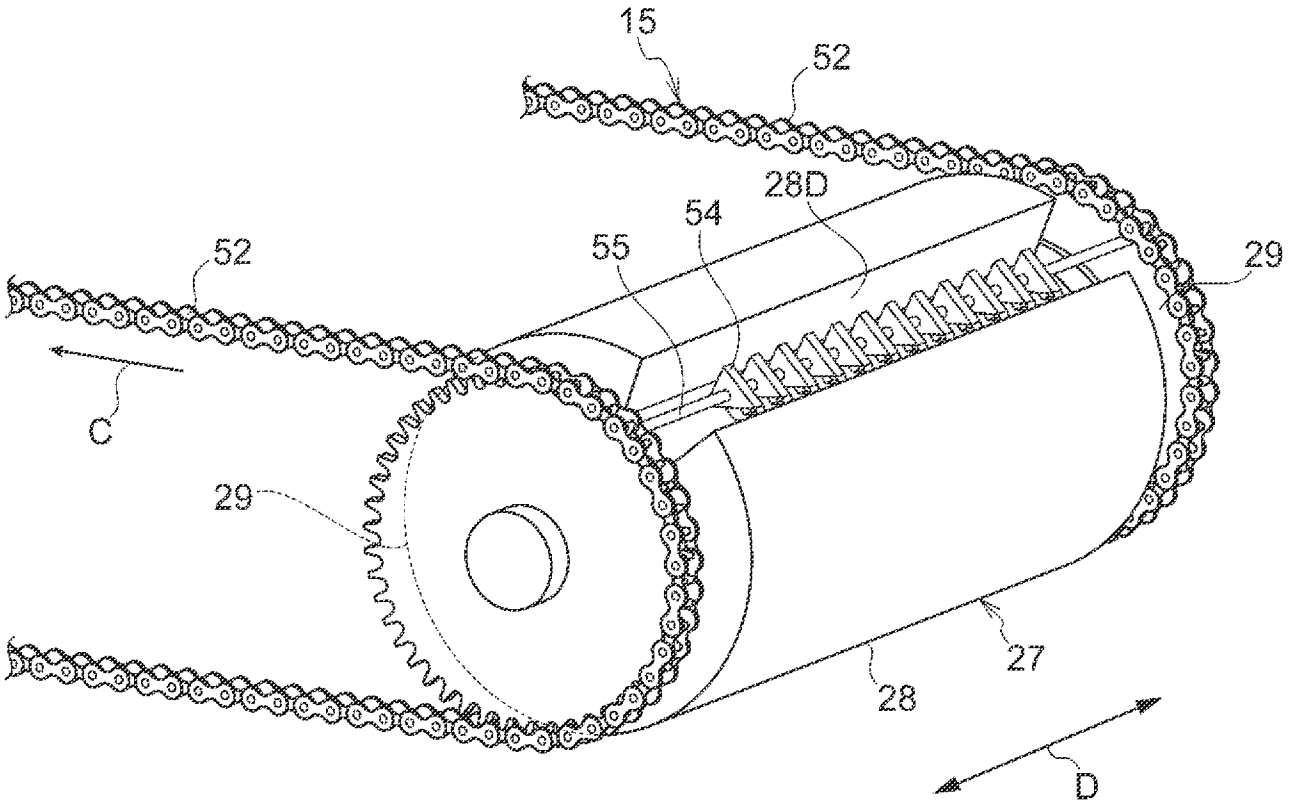
FIG. 2 is a perspective view showing a secondary transfer body according to the present exemplary embodiment.
Figure 3:
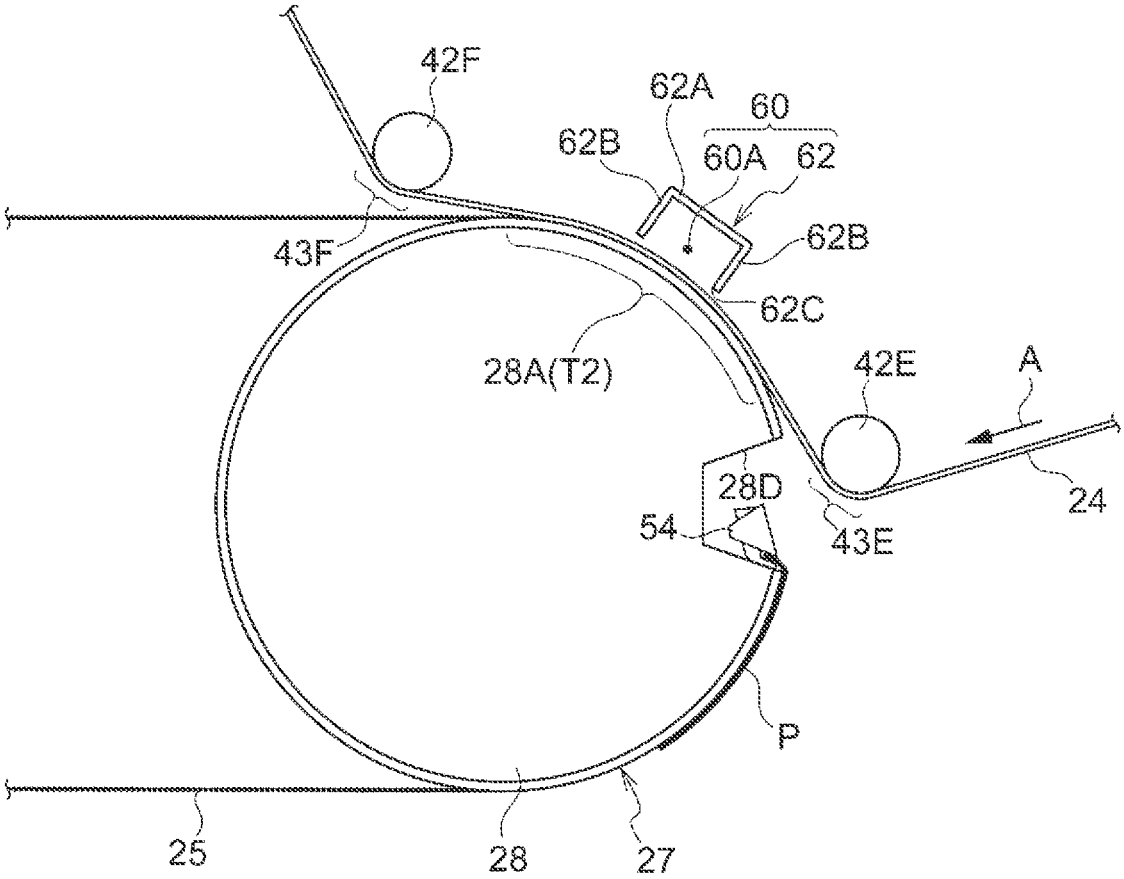
FIG. 3 is an enlarged side view showing a secondary transfer portion of the image forming apparatus according to the present exemplary embodiment.

The secondary transfer body 27 is an example of a transfer unit that transfers an image onto a recording medium. Specifically, as shown in FIG. 2, the secondary transfer body 27 includes a transfer cylinder 28 and a pair of sprockets 29. As shown in FIG. 3, the transfer cylinder 28 has a transfer nip region 28A as a nip region in which the recording medium P is nipped between the transfer cylinder 28 and the outer circumferential surface of the transfer belt 24. In FIG. 3, the recording medium P is simplified and a part thereof is shown.

The transfer nip region 28A is formed by wrapping the transfer belt 24 around the transfer cylinder 28. The transfer nip region 28A may also be referred to as a contact region where the transfer belt 24 and the transfer cylinder 28 are in contact with each other. Further, the transfer nip region 28A is set as the secondary transfer position T2 at which the toner image is transferred from the transfer belt 24 onto the recording medium P. The transfer cylinder 28 transports the recording medium P while sandwiching the recording medium P between the transfer cylinder 28 and the transfer belt 24 in the transfer nip region 28A.

As shown in FIG. 2, the pair of sprockets 29 are arranged on both end sides of the transfer cylinder 28 in an axial direction thereof. In other words, the transfer cylinder 28 is provided between the pair of sprockets 29. Further, the pair of sprockets 29 is arranged coaxially with the transfer cylinder 28 and rotates integrally with the transfer cylinder 28. The secondary transfer body 27 is rotationally driven by a driving unit (not shown).

On an outer circumference of the transfer cylinder 28, one recess 28D in which grippers 54 and an attachment member 55, which are to be described later, of a transport part 15 are accommodated is formed. Plural recesses 28D may be formed according to an arrangement interval of the grippers 54 along a rotation direction C of a chain 52 to be described later.

(Charging Unit 60)

As shown in FIG. 3, the charging unit 60 is arranged on an inner side of the transfer belt 24 so as to face the transfer cylinder 28. Specifically, the charging unit 60 is a charger (so-called corotron charging unit) that transfers the toner image on the transfer belt 24 by corona discharge.

More specifically, the charging unit 60 includes a discharge wire 60A and a case 62 (housing). The discharge wire 60A has a linear shape with a length along the axial direction of the transfer cylinder 28.

The case 62 surrounds the discharge wire. Specifically, the case 62 is formed in a box shape, and has an opening 62C on a transfer cylinder 28 side (that is, a lower side).

Specifically, the case 62 has a first wall 62A arranged on a side opposite the transfer cylinder 28 with respect to the discharge wire 60A, and a pair of second walls 62B arranged upstream and downstream of the discharge wire 60A in the belt rotation direction A. Further, the case 62 has third walls (not shown) arranged on both end sides of the discharge wire 60A in a length direction thereof.

In the charging unit 60, a voltage is applied to the discharge wire 60A and the discharge wire 60A discharges, so that the recording medium P is electrostatically attracted to the transfer belt 24 and the transfer cylinder 28. Further, in the charging unit 60, the transfer belt 24 is charged due to the discharge of the discharge wire 60A, and the toner images superimposed on the transfer belt 24 are transferred from the transfer belt 24 to the recording medium P in the transfer nip region 28A (secondary transfer position T2).

(Wrap rolls 42E, 42F)

The wrap rolls 42E, 42F shown in FIGS. 1 and 3 are a pair of wrap rolls on the inner side the transfer belt 24, around which the transfer belt 24 wraps. Specifically, the wrap rolls 42E, 42F are arranged upstream and downstream of the charging unit 60 in the belt rotation direction A. Further, wrapping portions 43E, 43F in the transfer belt 24 that wrap around the wrap rolls 42E, 42F are both separated from the transfer cylinder 28.

(Fixing Device 16)

The fixing device 16 shown in FIG. 1 is a device that fixes the toner image, which is transferred to the recording medium P by the transfer cylinder 28, on the recording medium P. More specifically, as shown in FIG. 1, the fixing device 16 includes a pressing body 67 serving as a pressure member, a heating roll 68 serving as a heating member, the transport part 15, a support body 70 (see FIGS. 4 and 5), and a moving mechanism 80 (see FIGS. 4 and 5).

(Pressing Body 67)

Figure 4:
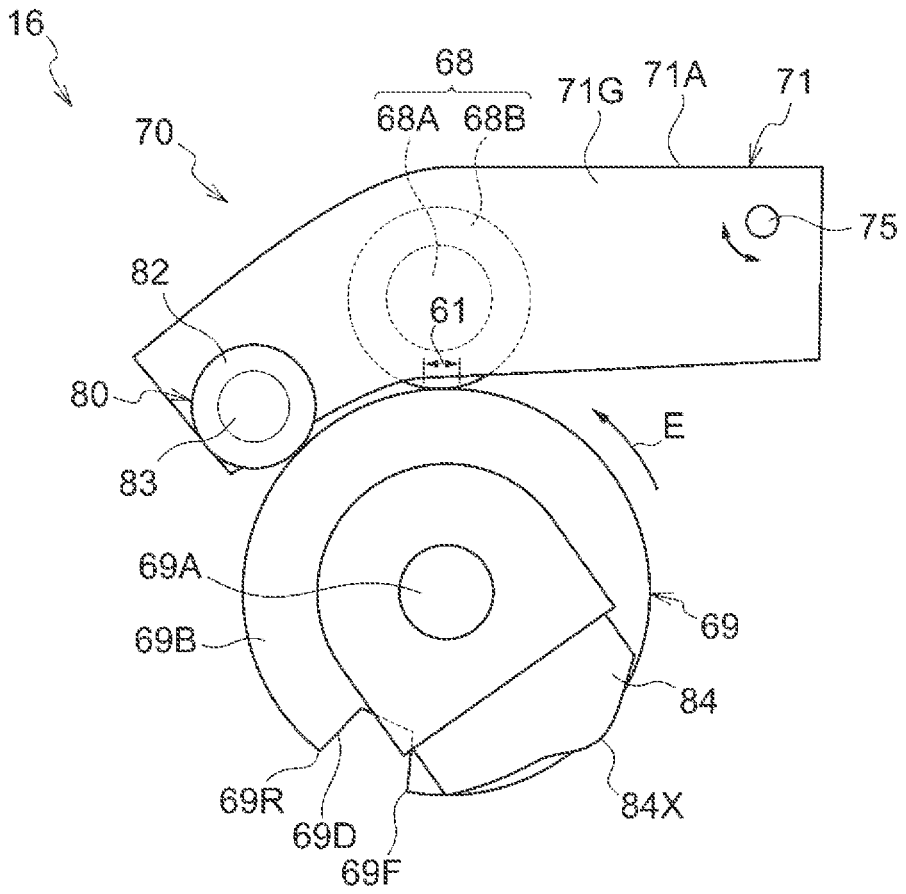
FIG. 4 is a front view showing a part of a fixing device according to the present exemplary embodiment.
Figure 5:
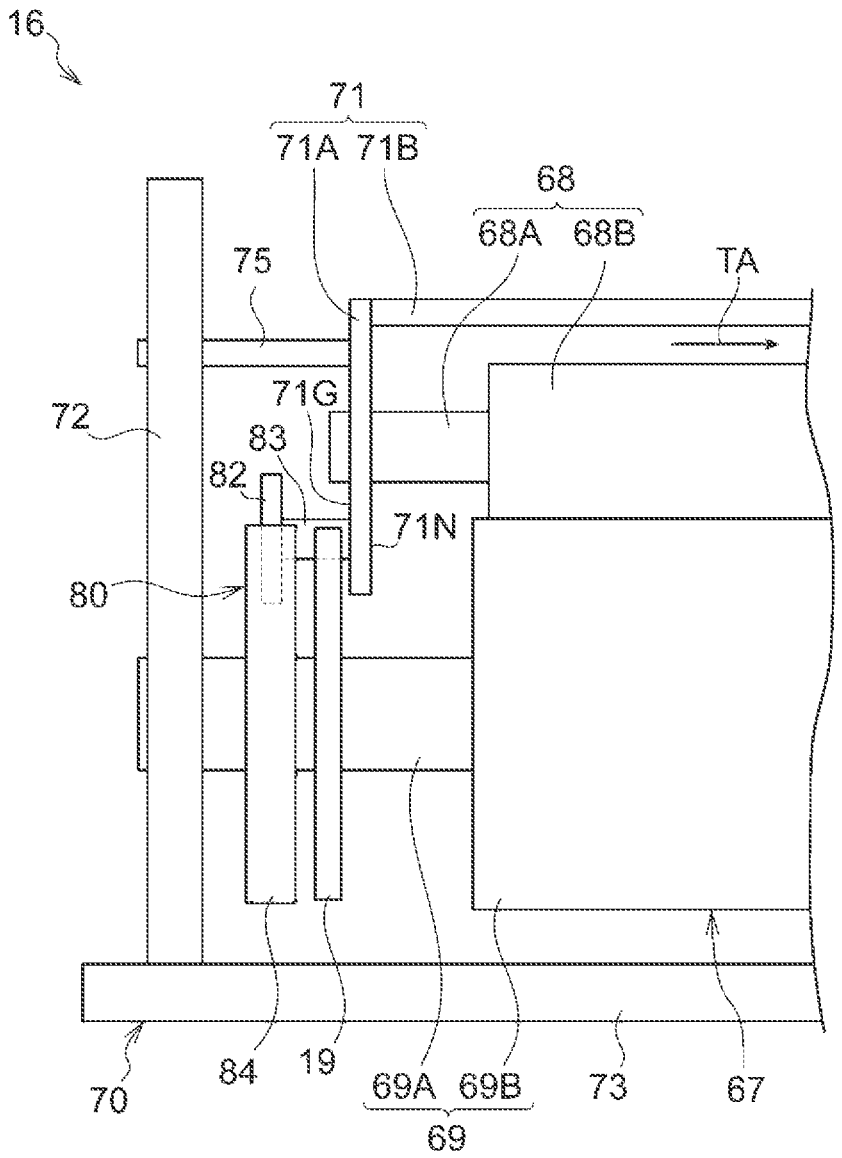
FIG. 5 is a side view showing a part of the fixing device according to the present exemplary embodiment.
Figure 6:
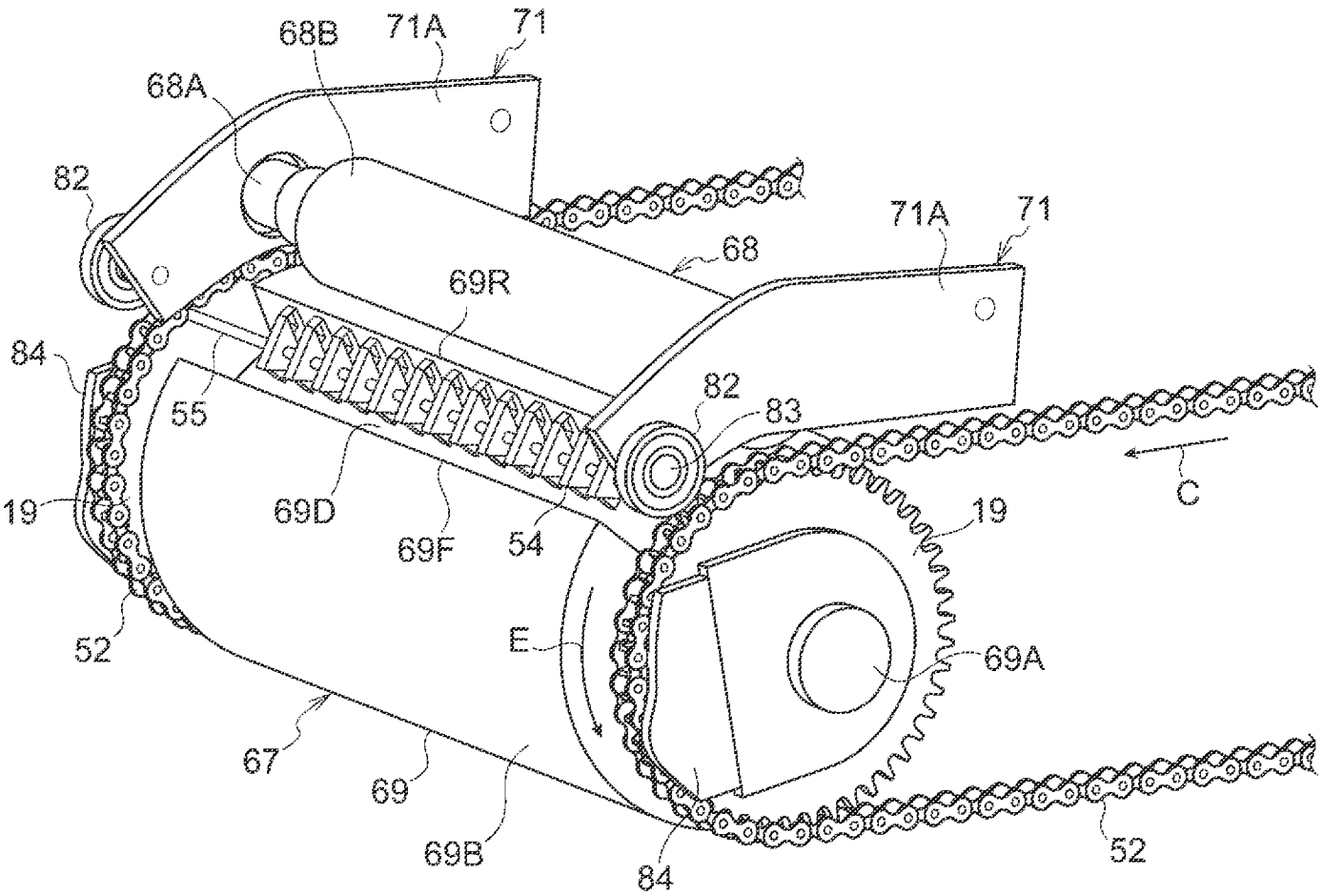
FIG. 6 is a perspective view showing a part of the fixing device according to the present exemplary embodiment.

As shown in FIG. 6, the pressing body 67 includes a pressure roll 69 and the pair of sprockets 19. The pressure roll 69 is an example of a first nipping part. The pressure roll 69 has a function of pressing the recording medium P by sandwiching the recording medium P between the pressure roll 69 and the heating roll 68. Specifically, as shown in FIGS. 4, 5, and 6, the pressure roll 69 includes a shaft portion 69A and a roll portion 69B formed on an outer circumference of the shaft portion 69A.

As shown in FIG. 6, the pair of sprockets 19 are arranged on both end sides of the pressure roll 69 in an axial direction thereof. In other words, the pressure roll 69 is provided between the pair of sprockets 19. Further, the pair of sprockets 19 are arranged coaxially with the pressure roll 69, and are configured to rotate integrally with the pressure roll 69.

Figure 7:
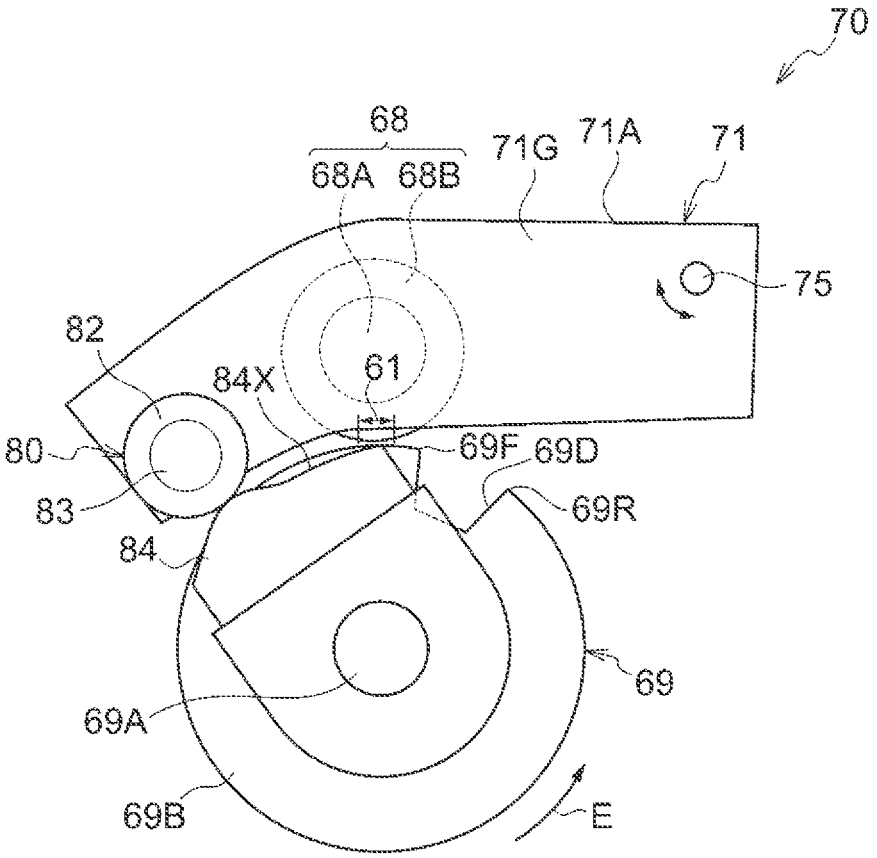
FIG. 7 is a front view showing a state in which a heating roll is located at a retracted position in the fixing device shown in FIG. 4.

Specifically, as shown in FIG. 5, the pair of sprockets 19 are fixed to the shaft portion 69A on axial outer sides of the roll portion 69B of the pressure roll 69. The axial outer side refers to a direction side from a center in the axial direction toward both ends in the axial direction. In FIG. 5, only one sprocket 19 in the pair of sprockets 19 is shown. In FIGS. 4 and 7, illustration of the sprockets 19 is omitted.

The pressure roll 69 is, for example, rotationally driven, via the shaft portion 69A, in a direction indicated by an arrow E shown in FIGS. 4 and 6 by a driving unit (not shown). Further, as shown in FIG. 6, on an outer circumference of the pressure roll 69, one recess 69D in which the grippers 54 and the attachment member 55 of the transport part 15 are accommodated is formed. As shown in FIGS. 4 and 6, the recess 69D is opened to an radial outer side of the pressure roll 69. The recess 69D has a corner portion 69F (hereinafter, referred to as a front end edge 69F) at a downstream end in the rotation direction of the pressure roll 69. Further, the recess 69D has a corner portion 69R (hereinafter, referred to as a rear end edge 69R) at an upstream end in the rotation direction of the pressure roll 69.

Plural recesses 69D may be formed according to an arrangement interval of the grippers 54 along the rotation direction C of the chain 52 to be described later.

(Heating Roll 68)

The heating roll 68 shown in FIG. 4 is an example of a second nipping part. The heating roll 68 has a function of heating the recording medium P. Specifically, as shown in FIGS. 4, 5, and 6, the heating roll 68 includes a shaft portion 68A and a roll portion 68B formed on an outer circumference of the shaft portion 68A.

By bring an outer circumferential surface (an example of an outer surface of the second nipping part) of the roll portion 68B of the heating roll 68 into contact with an outer circumferential surface (an example of an outer surface of the first nipping part) of the roll portion 69B of the pressure roll 69, a fixing nip region 61 (an example of a nip region) in which the recording medium P is nipped is formed by the heating roll 68 and the pressure roll 69.

(Support Body 70)

The support body 70 shown in FIG. 5 has a function of supporting the pressing body 67 and the heating roll 68. Specifically, as shown in FIG. 5, the support body 70 has a first frame 71, a pair of second frames 72, and a bottom wall 73. In FIG. 5, only one second frame 72 in the pair of second frames 72 is shown.

The bottom wall 73 is arranged below the pressing body 67. The bottom wall 73 is formed in a plate shape having a thickness in an upper-lower direction.

The first frame 71 has a pair of side walls 71A and a coupling wall 71B. The pair of side walls 71A are arranged on both end sides of the heating roll 68 in the axial direction thereof. In FIG. 5, only one side wall 71A in the pair of side walls 71A is shown.

As shown in FIG. 4, the side wall 71A is arranged above the pressure roll 69. Further, as viewed in the axial direction of the heating roll 68, the side wall 71A extends along the chain 52 toward an upstream side of the fixing nip region 61 in the transport direction (see FIG. 6), and extends along a circumferential direction of the pressure roll 69 toward a downstream side of the fixing nip region 61 in the transport direction (see FIG. 4).

As shown in FIG. 5, the coupling wall 71B extends from one of the pair of side walls 71A to the other of the pair of side walls 71A along the axial direction of the heating roll 68. The coupling wall 71B couples upper portions of the pair of side walls 71A to each other.

The pair of side walls 71A rotatably support the heating roll 68. A cam follower 82 to be described later is provided on an outer surface 71G of each of the pair of side walls 71A. The outer surface 71G of the side wall 71A is a surface opposite an inner surface 71N at which the pair of side walls 71A face each other.

The pair of second frames 72 are provided on an outer side of the pair of side walls 71A and on the bottom wall 73 so as to extend upward from the bottom wall 73. The outer side of the pair of side walls 71A is a side opposite a side (an arrow TA in FIG. 5) on which the pair of side walls 71A face each other. In other words, the pair of second frames 72 are arranged on both end sides of the pressing body 67 and the heating roll 68 in the axial direction thereof. The second frame 72 is formed in a plate shape having a thickness in the axial direction of the pressure roll 69.

The pair of second frames 72 rotatably support the pressure roll 69. Specifically, the pair of second frames 72 rotatably support the shaft portion 69A of the pressure roll 69 on both end sides in the axial direction. More specifically, the pair of second frames 72 rotatably support the shaft portion 69A of the pressure roll 69 on axial outer sides of the roll portion 69B (specifically, axial outer sides to be described later).

Further, the pair of second frames 72 support the first frame 71 via a rotation shaft 75 such that the first frame 71 is rotatable around the rotation shaft 75. As shown in FIG. 4, the rotation shaft 75 is arranged upstream of the fixing nip region 61 in the transport direction. The "upstream of the fixing nip region 61 in the transport direction" is an example of "a first side in the transport direction with respect to the nip region".

Figure 9:
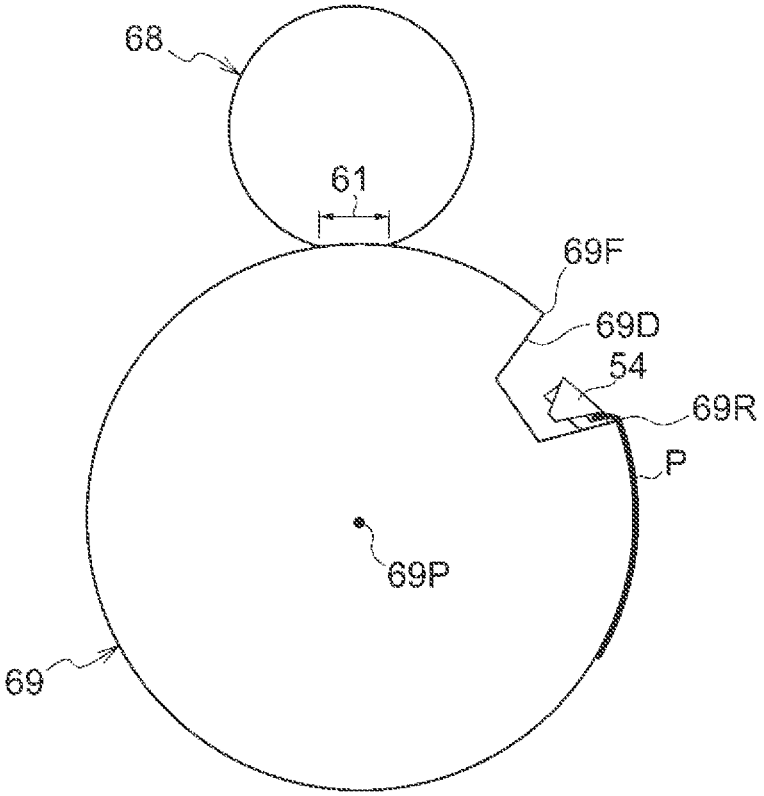
FIG. 9 is a front view schematically showing a positional relationship between the heating roll and a pressure roll according to the present exemplary embodiment.
Figure 10:
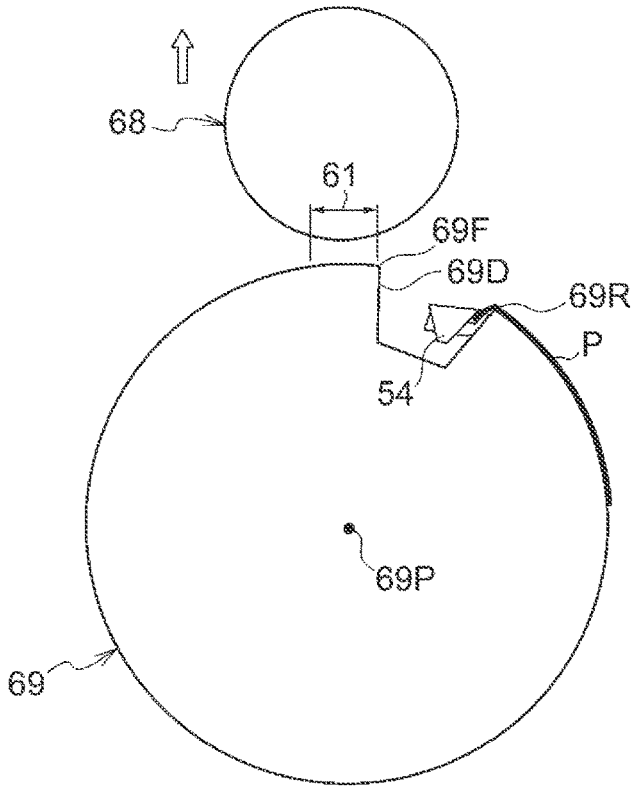
FIG. 10 is a front view schematically showing a positional relationship between the heating roll and the pressure roll according to the present exemplary embodiment.

Specifically, the pair of second frames 72 support the first frame 71 upstream of the fixing nip region 61 in the transport direction such that the heating roll 68 is movable between a nip position (an example of a first position) shown in FIGS. 4 and 9 and a retracted position (an example of a second position) shown in FIGS. 7 and 10.

That is, the heating roll 68 is movable between the nip position shown in FIGS. 4 and 9 and the retracted position shown in FIGS. 7 and 10 around a fulcrum upstream of the fixing nip region 61 in the transport direction. The nip position is a position at which a distance between the heating roll 68 and the pressure roll 69 is a distance at which the fixing nip region 61 is formed. The retracted position is a position at which the distance between the heating roll 68 and the pressure roll 69 is longer than the distance at the nip position. Specifically, the distance between the pressure roll 69 and the heating roll 68 means an inter-axis distance between the pressure roll 69 and the heating roll 68.

The first frame 71 is pushed or pulled by an elastic force of an elastic member such as a spring so as to locate the heating roll 68 to the nip position. That is, the heating roll 68 is pushed toward or pulled from the nip position.

In the fixing device 16, by heating and pressing the recording medium P by the heating roll 68 and the pressure roll 69, the toner image formed on the recording medium P is fixed on the recording medium P.

(Transport Part 15)

The transport part 15 shown in FIGS. 1 to 3 and 6 has a function of transporting the recording medium P. Specifically, the transport part 15 has a function of transporting the recording medium P to pass through the transfer nip region 28A (see FIG. 3) and the fixing nip region 61.

More specifically, as shown in FIGS. 1 and 2, the transport part 15 includes a pair of chains 52 and the grippers 54. The grippers 54 are an example of a holder that holds a front end side of the recording medium. In FIGS. 1 and 3, the chains 52 and the grippers 54 are shown in a simplified manner.

As shown in FIG. 1, the pair of chains 52 each are formed in an annular shape. As shown in FIGS. 2 and 6, the pair of chains 52 are arranged at an interval in an apparatus depth direction (direction D in FIG. 2). The pair of chains 52 respectively wraps around the pair of sprockets 29 (see FIG. 2) provided on the secondary transfer body 27 and the pair of sprockets 19 (see FIG. 6) provided on the pressing body 67. Further, by rotating the secondary transfer body 27 including the pair of sprockets 29 and the pressing body 67 including the pair of sprockets 19, the chains 52 are configured to rotate in the rotation direction C (direction indicated by an arrow C in FIGS. 1, 2, and 6).

As shown in FIGS. 2 and 6, the attachment member 55 to which the grippers 54 are attached is stretched across the pair of chains 52 along the apparatus depth direction. Plural attachment members 55 are fixed to the pair of chains 52 at predetermined intervals along the circumferential direction (rotation direction C) of the chain 52.

Figure 8:
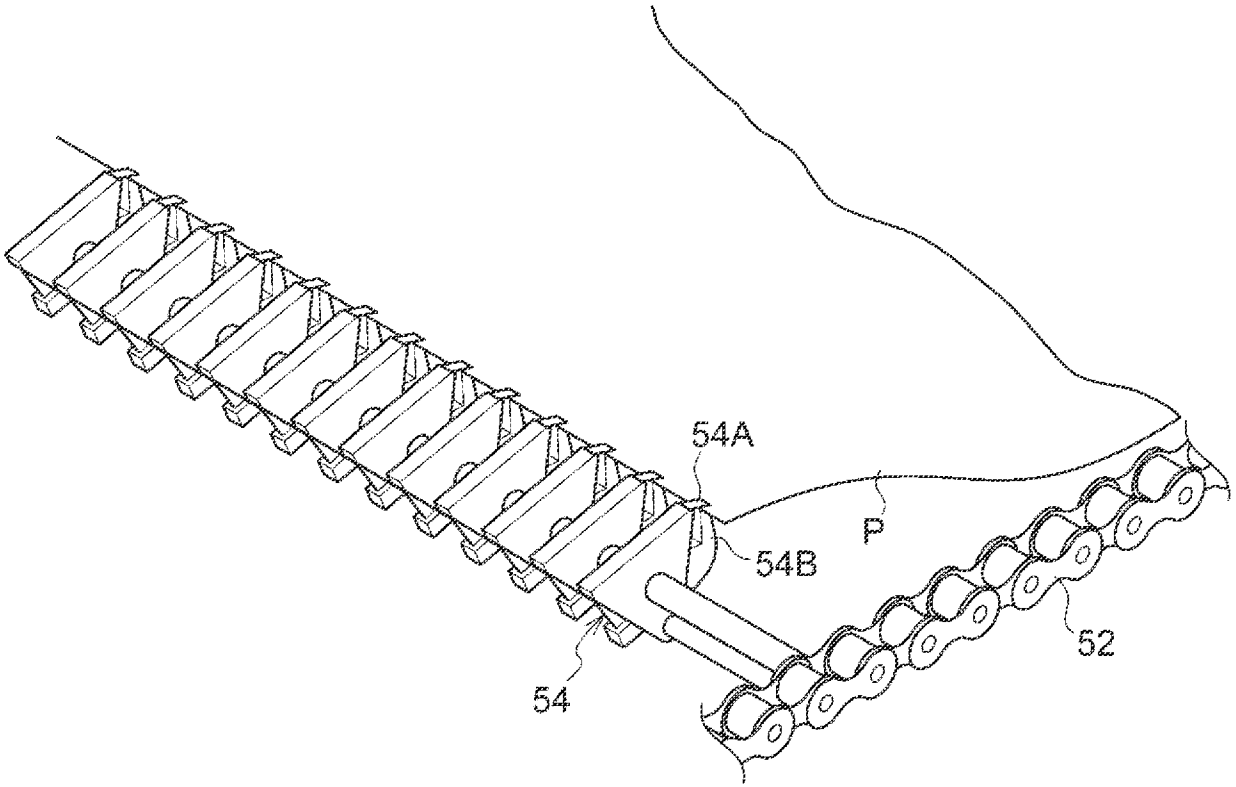
FIG. 8 is a perspective view showing grippers according to the present exemplary embodiment.

As shown in FIGS. 2 and 6, plural grippers 54 are attached to the attachment member 55 at predetermined intervals along the apparatus depth direction. In other words, the grippers 54 are attached to the chains 52 via the attachment members 55. The grippers 54 have a function of holding the front end portion of the recording medium P. Specifically, as shown in FIG. 8, the gripper 54 includes a claw 54A and a claw base 54B. The grippers 54 are configured to hold the recording medium P by sandwiching the front end portion of the recording medium P between the claws 54A and the claw bases 54B. In other words, the grippers 54 are an example of a holder that grips the recording medium P in the thickness direction.

More specifically, the grippers 54 hold the front end portion of the recording medium P outside an image region of the recording medium P. The image region of the recording medium P is a region in the recording medium P onto which the toner image is transferred. In the gripper 54, for example, the claw 54A is pressed against the claw base 54B by a spring or the like, and the claw 54A is opened and closed with respect to the claw base 54B by an action of a cam or the like.

As shown in FIG. 8, the transport part 15 holds, by the grippers 54, the front end portion of the recording medium P sent from an accommodating part (not shown) in which the recording medium P is accommodated. In the transport part 15, the chains 52 rotate in the rotation direction C in a state in which the grippers 54 hold the front end portion of the recording medium P, thus the grippers 54 are moved to transport the recording medium P, and the recording medium P passes through the transfer nip region 28A together with the grippers 54 while the recording medium P is being held by the grippers 54.

In a portion of the chain 52 which wraps around the sprocket 29, the grippers 54 are moved in the rotation direction of the transfer cylinder 28 integrally with the transfer cylinder 28 in a state of being accommodated in the recess 28D of the transfer cylinder 28.

Further, after transport the recording medium P to pass through the transfer nip region 28A, the transport part 15 further transports the recording medium P to pass through the fixing nip region 61 together with the grippers 54 while the recording medium P is being held by the grippers 54. In the portion of the chain 52 which wraps around the sprocket 19, the grippers 54 are moved in the rotation direction of the pressure roll 69 integrally with the pressure roll 69 in a state where the grippers 54 are accommodated in the recess 69D of the pressure roll 69.

(Moving Mechanism 80)

The moving mechanism 80 shown in FIGS. 4 and 5 is an example of a moving mechanism that moves the heating roll 68 relative to the pressure roll 69. Specifically, the moving mechanism 80 is a mechanism that moves the heating roll 68. More specifically, as shown in FIGS. 4 and 5, the moving mechanism 80 includes the cam followers 82 and cams 84.

The cam follower 82 is provided on the outer surface 71G of each of the pair of side walls 71A of the first frame 71. Specifically, as shown in FIG. 5, the cam follower 82 is rotatably supported by a front end portion of a shaft portion 83 that protrudes from the outer surface 71G of the side wall 71A to an outside of the side wall 71A.

More specifically, the cam follower 82 is provided downstream of the fixing nip region 61 in the transport direction. The "downstream of the fixing nip region 61 in the transport direction" is an example of "a second side in the transport direction with respect to the nip region". In other words, the cam follower 82 is arranged downstream of the heating roll 68 in the rotation direction of the pressure roll 69. That is, the cam follower 82 is deviated downstream of the heating roll 68 in the rotation direction of the pressure roll 69 by a predetermined rotation angle of the pressure roll 69.

As shown in FIG. 4, the cam follower 82 is formed in a circular disk shape as viewed in the axial direction of the heating roll 68. The cam follower 82 has an outer diameter smaller than an outer diameter of the heating roll 68 and an outer diameter of the pressure roll 69. In FIGS. 4 and 5, only one cam follower 82 of the pair of cam followers 82 is shown.

As shown in FIGS. 4 and 5, the cams 84 are provided on the pressure roll 69. Specifically, the cams 84 are provided at both end portions of the shaft portion 69A of the pressure roll 69. More specifically, as shown in FIG. 5, the cam 84 is fixed between the sprocket 19 in the shaft portion 69A of the pressure roll 69 and the second frame 72. In FIGS. 4 and 5, only one cam 84 of the pair of cams 84 is shown.

The cam 84 is arranged downstream of the recess 69D of the pressure roll 69 in the rotation direction of the pressure roll 69. That is, the cam 84 is deviated downstream of the recess 69D of the pressure roll 69 in the rotation direction of the pressure roll 69 by a predetermined rotation angle of the pressure roll 69. The deviation amount corresponds to the deviation amount of the cam follower 82 with respect to the heating roll 68.

Figure 13:
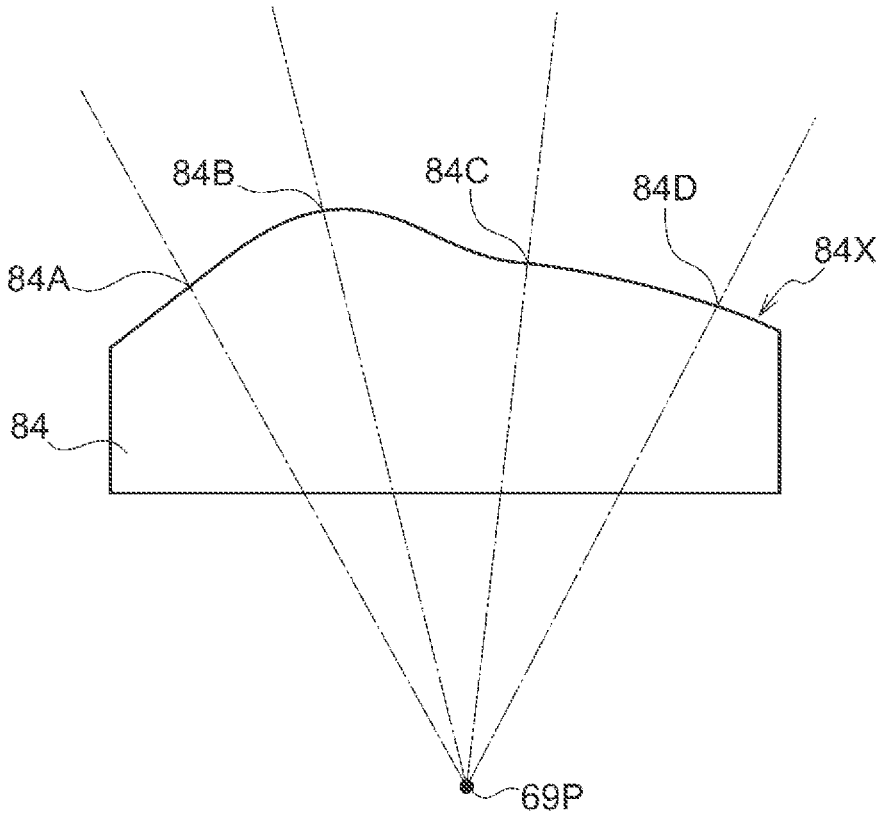
FIG. 13 is a diagram showing a cam according to the present exemplary embodiment.

The cam 84 is rotated integrally with the pressure roll 69, and is brought into contact with the cam follower 82 at a position facing the cam follower 82 (a position on an obliquely upper left side in FIG. 4). As shown in FIG. 13, the cam 84 has a cam surface 84X to which a distance from a rotation axis 69P of the pressure roll 69 varies.

In a portion 84B, the cam surface 84X has a longest distance from the rotation axis 69P of the pressure roll 69. That is, in the portion 84B, the cam surface 84X protrudes furthest to the radial outer side of the pressure roll 69.

In addition, the distance from the rotation axis 69P of the pressure roll 69 gradually decreases from the portion 84B toward a portion 84A. The portion 84A is positioned downstream of the portion 84B in the rotation direction of the pressure roll 69. Further, the distance from the rotation axis 69P of the pressure roll 69 gradually decreases from the portion 84B toward a portion 84C. The portion 84C is positioned upstream of the portion 84B in the rotation direction of the pressure roll 69. A length along the circumferential direction of the pressure roll 69 from the portion 84B to the portion 84C is shorter than a length along the circumferential direction of the pressure roll 69 from the portion 84B to the portion 84A. Therefore, an average of inclination from the portion 84B to the portion 84C of the cam surface 84X is smaller than an average of inclination from the portion 84B to the portion 84A of the cam surface 84X. Between the portion 84C and a portion 84D, the distance from the rotation axis 69P of the pressure roll 69 is constant. The portion 84D is positioned upstream of the portion 84C in the rotation direction of the pressure roll 69.

Then, as the pressure roll 69 rotates, the cam surface 84X comes into contact with the cam follower 82, and the cam 84 moves the heating roll 68 between the nip position and the retracted position. Specifically, the heating roll 68 operates as follows when a contact position of the cam 84 with respect to the cam follower 82 changes.

The heating roll 68 starts to move from the nip position to the retracted position before the recess 69D of the pressure roll 69 enters the fixing nip region 61 (hereinafter, this time point is referred to as a start time point A1). FIG. 9 shows a positional relationship between the heating roll 68 and the pressure roll 69 at the start time point A1. At the start time point A1, the cam 84 comes into contact with the cam follower 82 at the portion 84A in FIG. 13.

At the start time point, as shown in FIG. 9, the grippers 54 are also in a state before entering the fixing nip region 61. Therefore, it may be said that the heating roll 68 starts to move from the nip position to the retracted position before the grippers 54 enter the fixing nip region 61.

Further, when the recess 69D starts to enter the fixing nip region 61, the heating roll 68 is located at the retracted position (see FIG. 10). That is, when the front end edge 69F of the recess 69D starts to enter the fixing nip region 61, the heating roll 68 is located at the retracted position.

FIG. 10 shows a positional relationship between the heating roll 68 and the pressure roll 69 at a time point (hereinafter, referred to as an entry time point B1) at which the recess 69D starts to enter the fixing nip region 61. At the entry time point B1, the cam 84 comes into contact with the cam follower 82 at the portion 84B in FIG. 13. The fixing nip region 61 in a state where the heating roll 68 is not in contact with the pressure roll 69 means a place or a range where the fixing nip region 61 is formed in a case where the heating roll 68 is in contact with the pressure roll 69.

Since the grippers 54 enter the fixing nip region 61 later than the recess 69D, the grippers 54 are in a state before entering the fixing nip region 61 at the entry time point B1, as shown in FIG. 10.

Figure 11:
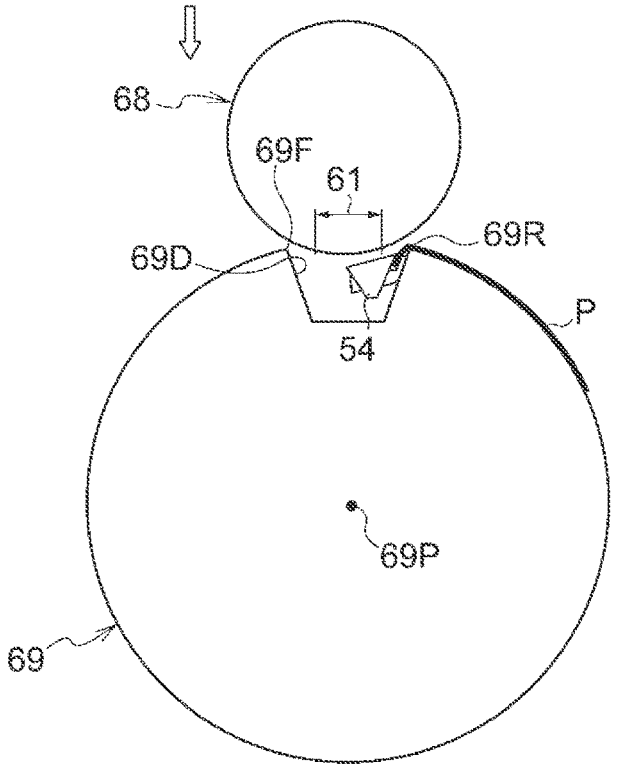
FIG. 11 is a front view schematically showing a positional relationship between the heating roll and the pressure roll according to the present exemplary embodiment.

Further, as shown in FIG. 11, after the recess 69D enters the fixing nip region 61, the heating roll 68 moves to the nip position (hereinafter, this time point is referred to as an end time point C1). Specifically, the heating roll 68 moves to the nip position before the recess 69D leaves the fixing nip region 61. More specifically, the heating roll 68 moves to the nip position after the front end edge 69F of the recess 69D leaves the fixing nip region 61 and before the rear end edge 69R enters the fixing nip region 61.

As shown in FIG. 11, the heating roll 68 moves to the nip position after the grippers 54 enter the fixing nip region 61. Specifically, the heating roll 68 moves to the nip position before the grippers 54 leave the fixing nip region 61.

At this nip position, the heating roll 68 is not in contact with the grippers 54 accommodated in the recess 69D. That is, the heating roll 68 moves to the nip position at which the heating roll 68 is not in contact with the grippers 54 located in the fixing nip region 61.

FIG. 11 shows a positional relationship between the heating roll 68 and the pressure roll 69 at the end time point C1. At the end time point C1, the cam 84 comes into contact with the cam follower 82 at the portion 84C in FIG. 13.

Further, the heating roll 68 maintains the state of being located at the nip position. Therefore, from entry of the rear end edge 69R of the recess 69D into the fixing nip region 61 to leaving the fixing nip region 61, the heating roll 68 is located at the nip position.

Further, it may be said that the heating roll 68 is located at the nip position when the grippers 54 leave the fixing nip region 61.

Figure 12:
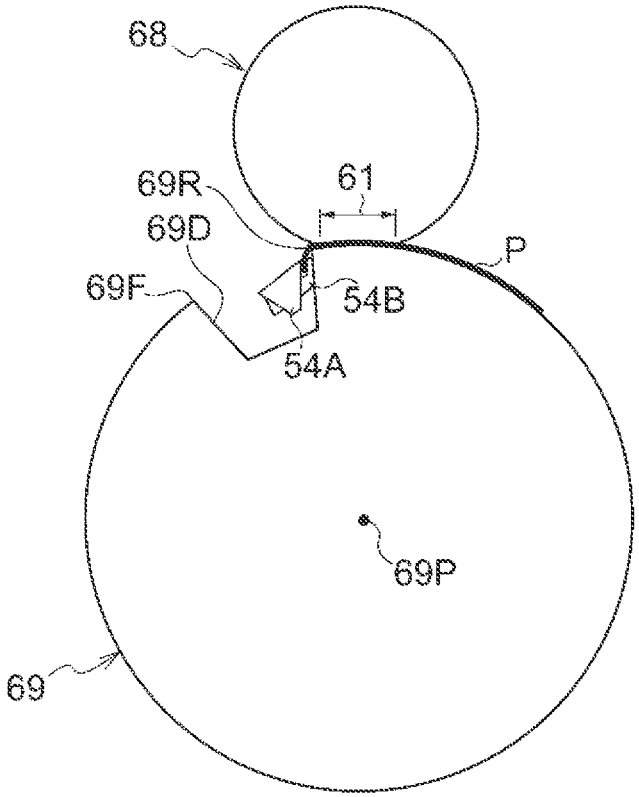
FIG. 12 is a front view schematically showing a positional relationship between the heating roll and the pressure roll according to the present exemplary embodiment.

FIG. 12 shows a positional relationship between the heating roll 68 and the pressure roll 69 at a time point (hereinafter, referred to as a leaving time point D1) when the rear end edge 69R of the recess 69D leaves the fixing nip region 61. At the leaving time point D1, the cam 84 comes into contact with the cam follower 82 at the portion 84D in FIG. 13.

Figure 14:
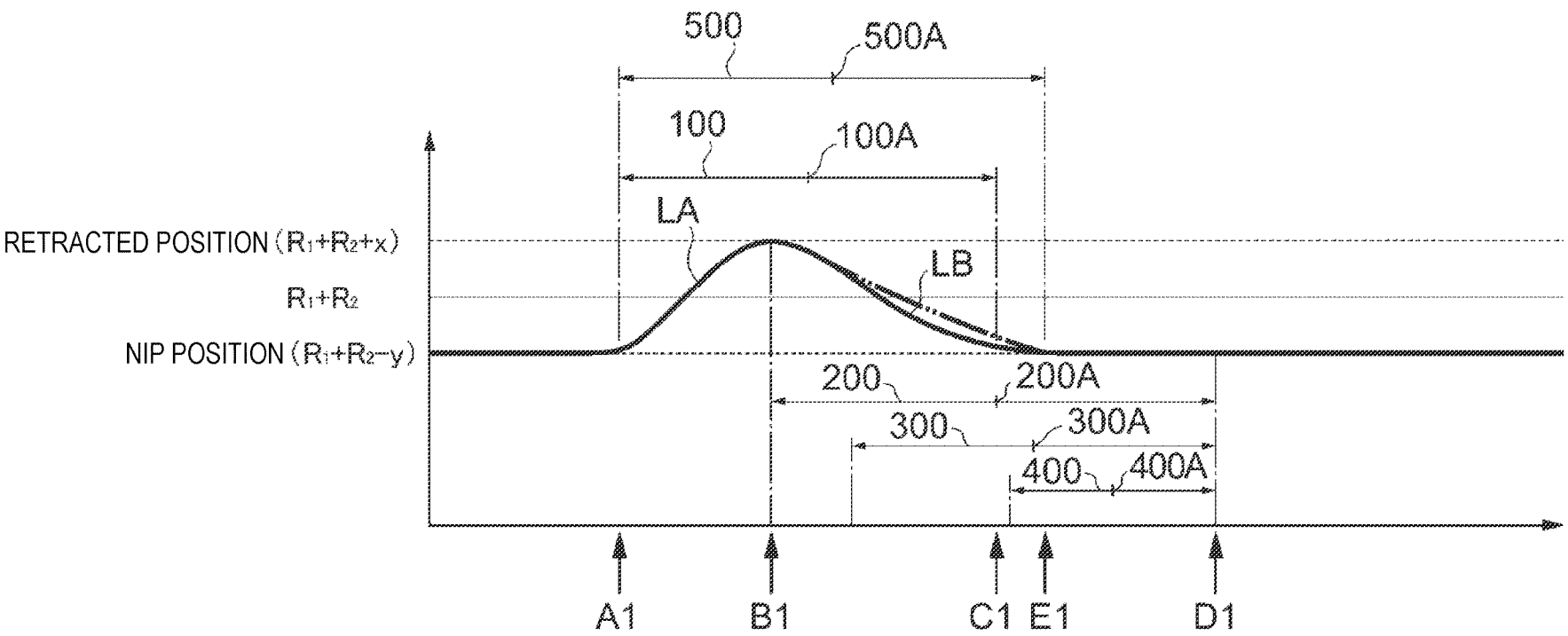
FIG. 14 is a diagram showing a relationship between an elapsed time (horizontal axis) and the positional relationship between the heating roll and the pressure roll (vertical axis)

FIG. 14 shows a relationship between an elapsed time and the positional relationship between the heating roll 68 and the pressure roll 69 (specifically, the inter-axis distance between the heating roll 68 and the pressure roll 69). In FIG. 14, the elapsed time is shown on a horizontal axis, and the positional relationship between the heating roll 68 and the pressure roll 69 is shown on a vertical axis. In FIG. 14, "$R_1$", "$R_2$", "x", and "y" indicate a "radius of the heating roll 68", a "radius of the pressure roll 69", a "retraction distance", and a "compression amount of an elastic layer of the heating roll 68", respectively. An arrow A1 and an arrow C1 in FIG. 14 indicate the start time point A1 and the end time point C1, respectively. Further, an arrow B1 and an arrow D1 in FIG. 14 indicate the entry time point B1 and the leaving time point D1, respectively. The horizontal axis in FIG. 14 may be regarded as a change in rotation angle of the pressure roll 69.

As the heating roll 68 moves as shown in FIGS. 9 to 12, a middle point 100A of a period 100 from the start time point A1 to the end time point C1 precedes a middle point 200A of a period 200 during which the recess 69D passes through the fixing nip region 61 as shown in FIG. 14.

In other words, in the present exemplary embodiment, the heating roll 68 moves such that the middle point 100A of the period 100 from the start time point A1 to the end time point C1 precedes the middle point 200A of the period 200 during which the recess 69D passes through the fixing nip region 61.

Further, in the present exemplary embodiment, the heating roll 68 moves such that the middle point 100A of the period 100 from the start time point A1 to the end time point C1 precedes a middle point 300A of a period 300 during which the grippers 54 pass through the fixing nip region 61.

Further, an amount of relative movement of the heating roll 68 from the retracted position to the nip position per unit time is smaller than an amount of relative movement of the heating roll 68 from the nip position to the retracted position per unit time. That is, in FIG. 14, inclination of a line LB from the arrow B1 to the arrow C1 is smaller than inclination of a line LA from the arrow A1 to the arrow B1.

(Operation According to Present Exemplary Embodiment)

In the present exemplary embodiment, as described above, the heating roll 68 moves such that the middle point 100A of the period from the start time point A1 to the end time point C1 precedes the middle point 200A of the period during which the recess 69D passes through the fixing nip region 61.

Here, in a configuration (first comparative example) in which the middle point 100A of the period from the start time point A1 to the end time point C1 coincides with the middle point 200A of the period during which the recess 69D passes through the fixing nip region 61, for example, the heating roll 68 moves to the nip position after the rear end edge 69R of the recess 69D leaves the fixing nip region 61, so that the timing at which the recording medium P is nipped between the pressure roll 69 and the heating roll 68 is delayed.

In contrast, in the present exemplary embodiment, since the heating roll 68 moves such that the middle point 100A precedes the middle point 200A, for example, the heating roll 68 moves to the nip position before the rear end edge 69R of the recess 69D leaves the fixing nip region 61. Therefore, the timing at which the recording medium P is nipped between the pressure roll 69 and the heating roll 68 is advanced as compared with the first comparative example. As a result, since the toner image is fixed from the front end side of the recording medium P, a range in which the toner image is fixable on the recording medium P is widened as compared with the first comparative example. In other words, according to the present exemplary embodiment, the range in which the toner image is to be formed on the recording medium P is widened as compared with the first comparative example.

In the present exemplary embodiment, the heating roll 68 moves such that the middle point 100A of the period from the start time point A1 to the end time point C1 precedes the middle point 300A of the period during which the grippers 54 pass through the fixing nip region 61.

Figure 15:
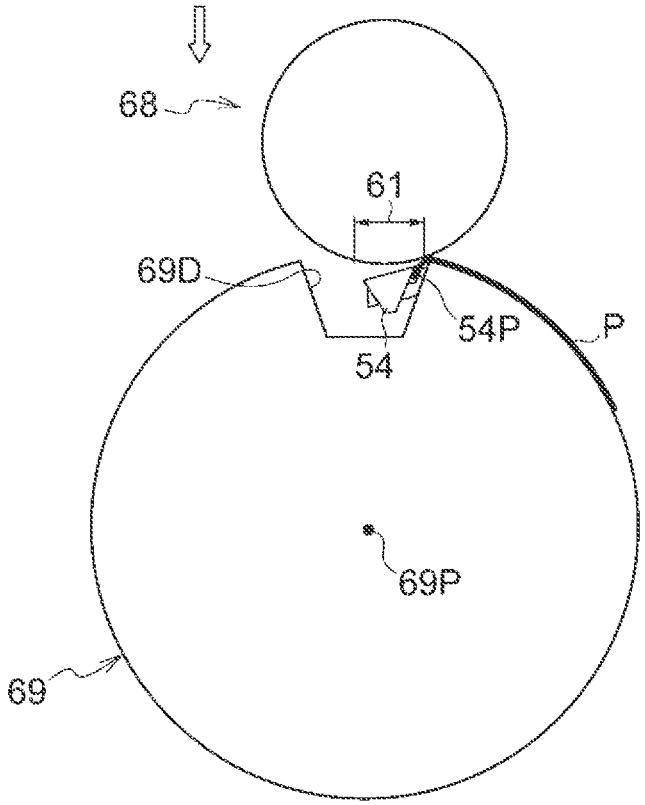
FIG. 15 is a front view schematically showing a positional relationship between a heating roll and a pressure roll according to a modification.

Here, in a configuration (second comparative example) shown in FIG. 15 in which the middle point 100A of the period from the start time point A1 to the end time point C1 coincides with the middle point 300A of the period during which the grippers 54 pass through the fixing nip region 61, for example, the heating roll 68 moves to the nip position after the rear end edge 69R of the recess 69D leaves the fixing nip region 61, so that the timing at which the recording medium P is nipped between the pressure roll 69 and the heating roll 68 is delayed.

In contrast, in the present exemplary embodiment, since the heating roll 68 moves such that the middle point 100A precedes the middle point 300A, for example, the heating roll 68 moves to the nip position before the rear end edge 69R of the recess 69D leaves the fixing nip region 61, so that the timing at which the recording medium P is nipped between the pressure roll 69 and the heating roll 68 is advanced as compared with the second comparative example.

Further, in the present exemplary embodiment, since the heating roll 68 moves to the nip position before the rear end edge 69R of the recess 69D leaves the fixing nip region 61, the range in which the recording medium P is nipped between the pressure roll 69 and the heating roll 68 is widened as compared with a configuration in which the heating roll 68 moves to the nip position after the rear end edge 69R of the recess 69D leaves the fixing nip region 61.

Further, in the present exemplary embodiment, since the heating roll 68 moves to the nip position before the grippers 54 leave the fixing nip region 61, the range in which the recording medium P is nipped between the pressure roll 69 and the heating roll 68 is widened as compared with a configuration in which the heating roll 68 moves to the nip position after the grippers 54 leave the fixing nip region 61.

In the present exemplary embodiment, the heating roll 68 moves to the nip position at which the heating roll 68 is not in contact with the grippers 54 located in the fixing nip region 61. Therefore, interference between the heating roll 68 and the grippers 54 is prevented as compared with a configuration in which the heating roll 68 is in contact with the grippers 54 located in the fixing nip region 61 at the nip position.

In the present exemplary embodiment, the heating roll 68 is movable around a fulcrum upstream of the fixing nip region 61 in the transport direction, and the cam follower 82 is provided downstream of the fixing nip region 61 in the transport direction.

Therefore, as compared with a configuration in which the fulcrum and the cam follower 82 are arranged on the first side in the transport direction with respect to the fixing nip region 61, since the fulcrum and a force point are separated from each other, the heating roll 68 is moved with a smaller load. Further, as compared with a configuration in which the cam follower 82 is provided upstream of the fixing nip region 61 in the transport direction, the cam follower 82 is prevented from interfering with a member arranged upstream of the fixing nip region 61 in the transport direction.

Further, in the present exemplary embodiment, the amount of relative movement of the heating roll 68 from the retracted position to the nip position per unit time is smaller than the amount of relative movement of the heating roll 68 from the nip position to the retracted position per unit time.

Accordingly, as compared with a configuration in which the amount of relative movement of the heating roll 68 from the retracted position to the nip position per unit time is larger than the amount of relative movement of the heating roll 68 from the nip position to the retracted position per unit time, the heating roll 68 is quickly separated from the pressure roll 69, and the heating roll 68 is slowly brought close to the pressure roll 69. As a result, vibration due to contact between the heating roll 68 and the pressure roll 69 is prevented.

(Modification of Operation of Heating Roll 68)

In the exemplary embodiment described above, as shown in FIG. 11, the heating roll 68 moves to the nip position after the recess 69D enters the fixing nip region 61, but the present disclosure is not limited thereto.

For example, as shown in FIG. 15, the heating roll 68 may move to the nip position after the holding position 54P of the recording medium P by the grippers 54 enters the fixing nip region 61. In this configuration, the heating roll 68 moves to the nip position before the holding position 54P leaves the fixing nip region 61.

In the present configuration, as shown in FIG. 14, a time point E1 at which the heating roll 68 moves to the nip position is later than the end time point C1.

Further, as shown in FIG. 14, a middle point 500A of a period 500 from the start time point A1 to the time point E1 precedes a middle point 400A of a period 400 during which the holding position 54P of the recording medium P by the grippers 54 passes through the fixing nip region 61.

In other words, in the present exemplary embodiment, the heating roll 68 moves such that the middle point 500A of the period 500 from the start time point A1 to the time point E1 precedes the middle point 400A of the period 400 during which the holding position 54P of the recording medium P by the grippers 54 passes through the fixing nip region 61.

As described above, in the present modification, since the heating roll 68 moves such that the middle point 500A precedes the middle point 400A, for example, the timing at which the recording medium P is nipped between the pressure roll 69 and the heating roll 68 is advanced as compared with a configuration (third comparative example) in which the middle point 500A and the middle point 400A coincide with each other. As a result, according to the present exemplary embodiment, since the toner image is fixed from the front end side of the recording medium P, the range in which the toner image is fixable on the recording medium P is widened as compared with the third comparative example. In other words, according to the present exemplary embodiment, the range in which the toner image is fixable on the recording medium P is widened as compared with the third comparative example.

(Other Modifications)

In the present exemplary embodiment, the heating roll 68 is configured to move, but the pressure roll 69 may be configured to move. That is, the heating roll 68 and the pressure roll 69 may be configured to move relative to each other.

In the present exemplary embodiment, as shown in FIG. 4, the rotation shaft 75 is positioned upstream of the fixing nip region 61 in the transport direction, but the present disclosure is not limited thereto. For example, the rotation shaft 75 may be positioned downstream of the fixing nip region 61 in the transport direction. In this case, the cam follower 82 is arranged, for example, upstream of the fixing nip region 61 in the transport direction.

Further, in the present exemplary embodiment, the grippers 54 hold the front end portion of the recording medium P, but the present disclosure is not limited thereto. For example, the grippers 54 may be configured to hold the front end side of the recording medium P from a lateral end side of the recording medium P. The front end side of the recording medium is a portion downstream (forward) of a center of the recording medium in the transport direction.

Further, in the present exemplary embodiment, a case has been described in which an example of the transport device is a fixing device having a transporting function of transporting the recording medium P and a fixing function of fixing an image onto the recording medium P, but the present disclosure is not limited thereto. The transport device may be, for example, a device having only the transporting function, or a device having a function other than the fixing function and the transporting function.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transport device comprising:

a first nipping part having an outer surface;

a second nipping part having an outer surface, the second nipping part being configured to form, with the first nipping part, a nip region in which a recording medium is nipped by bringing the outer surface of the second nipping part into contact with the outer surface of the first nipping part, the second nipping part being relatively movable between a first position at which a distance from the second nipping part to the first nipping part is a first distance at which the nip region is formed and a second position at which the distance from the second nipping part to the first nipping part is longer than the first distance;

a transport part including a holder that holds a front end side of the recording medium, the transport part being configured to move the holder to transport the recording medium to pass through the nip region together with the holder while the recording medium is being held by the holder; and a moving mechanism configured to relatively move the second nipping part such that a middle point of a period from when a relative movement of the second nipping part from the first position to the second position is started before a holding position of the recording medium by the holder enters the nip region to when the second nipping part is relatively moved to the first position after the holding position enters the nip region precedes a middle point of a period during which the holding position passes through the nip region.

2. The transport device according to claim 1, wherein the moving mechanism relatively moves the second nipping part to the first position before the holding position leaves the nip region.

3. The transport device according to claim 2, wherein the moving mechanism relatively moves the second nipping part to the first position at which the second nipping part is not in contact with the holder located in the nip region.

4. The transport device according to claim 1, wherein the second nipping part is relatively movable between the first position and the second position around a fulcrum on a first side in a transport direction with respect to the nip region, and the moving mechanism includes:

a cam follower provided on a second side in the transport direction with respect to the nip region, and a cam provided on the first nipping part and configured to come into contact with the cam follower to relatively move the second nipping part as the first nipping part rotates.

5. The transport device according to claim 4, wherein the fulcrum is positioned upstream of the nip region in the transport direction, and the cam follower is provided downstream of the nip region in the transport direction.

6. A fixing device as the transport device according to claim 1, wherein an amount of relative movement of the second nipping part from the second position to the first position per a unit of time is smaller than an amount of relative movement from the first position to the second position per the unit of time.

7. A fixing device as the transport device according to claim 1, wherein the first nipping part is a pressure roll, and the second nipping part is a heating roll.

8. An image forming apparatus comprising:

a transfer unit configured to transfer an image to a recording medium; and the fixing device according to claim 7 configured to fix, on the recording medium, the image transferred to the recording medium.

9. A transport device comprising:

a first nipping part having an outer surface;

a second nipping part having an outer surface, the second nipping part being configured to form, with the first nipping part, a nip region in which a recording medium is nipped by bringing the outer surface into contact with the outer surface of the first nipping part, the second nipping part being relatively movable between a first position at which a distance from the second nipping part to the first nipping part is a first distance at which the nip region is formed and a second position at which the distance from the second nipping part to the first nipping part is longer than the first distance;

a transport part including a holder that holds a front end side of the recording medium, the transport part being configured to move the holder to transport the recording medium to pass through the nip region together with the holder while the recording medium is being held by the holder; and a moving mechanism configured to relatively move the second nipping part such that a middle point of a period from when a relative movement of the second nipping part from the first position to the second position is started before the holder enters the nip region to when the second nipping part is relatively moved to the first position after the holder enters the nip region precedes a middle point of a period during which the holder passes through the nip region.

10. The transport device according to claim 9, wherein the moving mechanism relatively moves the second nipping part to the first position before the holder leaves the nip region.

11. The transport device according to claim 10, wherein the moving mechanism relatively moves the second nipping part to the first position at which the second nipping part is not in contact with the holder located in the nip region.

12. A transport device comprising:

a first nipping part having an outer surface and a recess on a part of the outer surface, the first nipping part being configured to rotate in a rotation direction;

a second nipping part having an outer surface, the second nipping part being configured to form, with the first nipping part, a nip region in which a recording medium is nipped by bringing the outer surface of the second nipping part into contact with the outer surface of the first nipping part, the second nipping part being relatively movable between a first position at which a distance from the second nipping part to the first nipping part is a first distance at which the nip region is formed and a second position at which the distance from the second nipping part to the first nipping part is longer than the first distance;

a transport part including a holder that holds a front end side of the recording medium, the transport part being configured to move the holder in the rotation direction with the holder being accommodated in the recess to transport the recording medium to pass through the nip region together with the holder while the recording medium is being held by the holder; and a moving mechanism configured to relatively move the second nipping part such that a middle point of a period from when a relative movement of the second nipping part from the first position to the second position is started before the recess enters the nip region to when the second nipping part is relatively moved to the first position after the recess enters the nip region precedes a middle point of a period during which the recess passes through the nip region.

13. The transport device according to claim 12, wherein the moving mechanism relatively moves the second nipping part to the first position before the recess leaves the nip region.

14. The transport device according to claim 13, wherein the moving mechanism relatively moves the second nipping part to the first position at which the second nipping part is not in contact with the holder located in the nip region.

* * * * *